US007204367B2

(12) United States Patent
Bott et al.

(10) Patent No.: US 7,204,367 B2
(45) Date of Patent: Apr. 17, 2007

(54) METHOD AND DEVICE FOR STORING DECORATIVE LIGHT STRINGS

(76) Inventors: Ryan L. Bott, 1699 N. 210 E., Orem, UT (US) 84057; Randy L. Bott, 1699 N. 210 East, Orem, UT (US) 84057; Michael J. Moran, 206 Mt. Pleasant Rd., New Bern, NC (US) 28560

( * ) Notice: Subject to any disclaimer, the term of this patent is extended or adjusted under 35 U.S.C. 154(b) by 549 days.

(21) Appl. No.: 10/843,519

(22) Filed: May 11, 2004

(65) Prior Publication Data

US 2005/0252807 A1 Nov. 17, 2005

(51) Int. Cl.
*B65D 25/08* (2006.01)
*B65D 73/00* (2006.01)
*B65B 63/04* (2006.01)

(52) U.S. Cl. ..... 206/219; 206/463; 206/471; 206/409; 53/430; 53/473

(58) Field of Classification Search ..... 206/461–463, 206/471, 419, 420, 389, 409; 53/430, 473
See application file for complete search history.

(56) References Cited

U.S. PATENT DOCUMENTS

| | | | | | |
|---|---|---|---|---|---|
| 3,683,928 | A * | 8/1972 | Kuntz | 604/171 |
| 4,124,953 | A * | 11/1978 | Patton | 47/69 |
| 4,637,516 | A * | 1/1987 | de Roure | 206/471 |
| 5,875,893 | A * | 3/1999 | Lee et al. | 206/463 |
| 5,908,111 | A * | 6/1999 | Purdy | 206/461 |
| 5,992,787 | A * | 11/1999 | Burke | 242/388.1 |
| 6,076,675 | A * | 6/2000 | Pawlowski | 206/459.5 |
| 6,109,005 | A * | 8/2000 | Fogle | 53/430 |
| 6,802,173 | B1 * | 10/2004 | Fogle | 53/430 |
| 2004/0222264 | A1 * | 11/2004 | Tan | 225/106 |

* cited by examiner

*Primary Examiner*—Jia M. Mohandesi

(57) ABSTRACT

A unique dispensing package easily, quickly and economically encases decorative light strings within a thin walled, flexible plastic tube. The plastic tube is provided to the user as a longitudinally compressed hollow column encased in the dispensing package. As a string of lights is passed through the hollow column, the tube is expanded and dispensed onto the string. The string of lights is thereby protected against damage and dust. The plastic tube also prevents tangling of the light string, permitting greater convenience for storage and for reuse.

9 Claims, 4 Drawing Sheets

METHOD AND DEVICE FOR STORING DECORATIVE LIGHT STRINGS

CROSS-REFERENCE TO RELATED APPLICATIONS

Not applicable.

BACKGROUND

1. Field of Invention

This invention relates to the storage of strings of decorative lights and physically similar items.

2. Description of Prior Art

The greatest problem associated with storing, and reusing, Christmas-tree-light strings is their very great tendency to tangle. It can be very time consuming and frustrating to untangle and separate multiple light strings. Sometimes the untangling operation causes damage to lights or to electrical connections. An ideal decorative-light-string storage device would require no more storage space than the light string itself. It would permit dumping the string into a handy box with other light strings, or coiling the string and hanging it on a peg. It would be inexpensive. It would protect the lights and wires. It would be quick and easy to use. And it would prevent tangling.

Most of the prior art dealing with light string storage seems to use reels or other winding or wrapping means. For example, U.S. Pat. No. 5,598,985 to Winesett (1997) teaches the use of a reel to store light strings between uses. There are several difficulties associated with such devices. Many of the reel concepts require mounting the reel, necessitating a dedicated location. When many strings must be stored—a common occurrence in our current culture—the number of mounted reels can become unwieldy. The nature of winding a light string on a small diameter shaft precludes the storage of strings with large, or elongated, or branching lights or ornaments. Not inconsequentially, such devices are not inexpensive. Most decorators would obviously rather spend limited decorating budgets on decorations rather than on decoration storage devices.

Several U.S. patents teach the use of a flexible, thin-walled, plastic tube or sheath which encloses light strings for storage. The benefits of this approach for making the strings "storable " make it an advancement over reeling and winding methods. The sheath protects the light string from dust and incidental handling, and most importantly, protects strings from tangling. When strings are stored in this manner, they are easily unwound and separated. When the sheath is removed—which is easily done—the light string is ready for use.

Patents that teach this approach extol the benefits of storing light strings in a thin walled plastic tube. However, their claims, and their differences, deal with how each gets a light string into such a tube.

U.S. Pat. No. 4,987,724 to Rutherford (1991) requires that the user manually place a long plastic sleeve—16 feet, for example—onto a cord having a gripping collar. The sleeve is bunched up as it is put onto the cord. After the sleeve is on the cord, a string of lights is attached the cord, and the sleeve pulled over the light string. The sleeve is unbunched as it is pulled off of the cord to cover the light string. No mention is made of how the long plastic sleeve is supplied or handled. It is obvious that although the light string is eventually enclosed within a plastic sleeve, the process is cumbersome and time consuming. The cost of the associated apparatus and the complicated procedure make this approach unsuited for a disposable, low-cost, consumer product.

U.S. Pat. No. 6,009,688 to Pedersen, et. al. (2000) teaches an approach that is much simpler and more convenient to use than that taught by Rutherford. Pedersen would supply a thin walled plastic tube already collapsed and bunched up on a hollow cylinder. The cylinder is mounted, at one end, to an interior wall of a box. There is a hole in the box wall that corresponds to the hole in the cylinder. The opposite wall also has a hole that corresponds to the hole in the cylinder, but does not touch the cylinder. It is, however, positioned close to the cylinder. As a string of lights is passed through the holes in the box—and thus through the hole in the cylinder—the bunched plastic tube is dispensed off of the cylinder and onto the light string.

Pre-collapsing the plastic tube onto a cylinder makes the process more practical for the user. However, there are several problems associated with Pedersen's art. To achieve practical economics for a disposable product, the device will need to be made from paperboard, as is described in the preferred embodiment. Such a construction is not likely to be rigid enough to withstand the retail and home environments without distortion.

To easily dispense the collapsed plastic tube and pass the string of lights, the cylinder must maintain its shape and its alignment with the dispensing hole in the side of the box. The cylinder is a cantilever mounted to the side of the box opposite the dispensing hole. This arrangement makes it difficult for a paperboard construction to maintain a rigid relationship between the free end of the cantilever and the dispensing hole.

Also, as disclosed by Pedersen, the tubing must be collapsed onto the hollow cylinder while the box is in an unfolded, or flat, state. During this operation, the cylinder is an upright cantilever fixedly attached to the horizontal box cutout. Then the six box sides and seven tabs must be sequentially folded and glued to obtain the final product. This is an impractical procedure for mass production, and will significantly affect the cost of the device.

Thus, while pre-collapsing the tubing onto a hollow cylinder solves some of the prior art problems, it also creates problems of reliability and cost.

U.S. Pat. No. 6,237,769 to Collom, et. al. (2001) teaches the use of a "flexible lightweight plastic tube" for storing light strings. However, the procedure for placing the light string in the tube is more complicated and cumbersome than Pedersen's, and the apparatus is more costly to manufacture than that described by Pedersen.

SUMMARY

A tube of thin and flexible plastic film is quickly and easily dispensed over a string of lights. The tube provides protection from dust and damage, and it prevents tangling during storage. The plastic tube is provided as a longitudinally compressed hollow column. For example, a 35-foot long tube might be compressed to form a column with a height of 1½ inches and a diameter of 3½ inches. The shape and dimensions of the hollow column are maintained by constraining surfaces at the top, bottom, and outer surfaces of the column. The constraining surfaces at the top and at the bottom each have a hole that is concentric with the hole through the column, which might be 2 inches in diameter, for example. As a string of lights is passed through the hollow column, the tube is expanded and dispensed onto the string. The constraining surfaces that maintain the shape of the column also serve as the sales package. The device is small, robust, and economical to produce.

OBJECTS AND ADVANTAGES

Accordingly, several objects and advantages of the present invention are:

(a) To provide a light string storage device that does not add appreciably to the mass and volume of the light string;

(b) To provide a light string storage device that is quick and easy to use;

(c) To provide a light string storage device that is disposable;

(d) To provide a light string storage device fabricated from recyclable materials;

(e) To provide a light string storage device that does not require a dedicated mounting location;

(f) To provide a light string storage device that is less costly to manufacture;

(g) To provide a light string storage device that is robust enough for the retail and home environments;

(h) To provide a light string storage device with a small point of sale package;

(i) To provide a light string storage device that provides dust and damage protection for the stored string of lights;

(j) To provide a light string storage device that prevents tangling of the light string;

(k) To provide a light string storage device that permits quick and easy reuse of the stored light string;

(l) And to provide a light string storage device that permits light strings to be stored in bulk containers with other strings, or to be coiled and hung on a peg.

Still further objects and advantages will become apparent from a consideration of the ensuing descriptions and drawings.

DRAWING FIGURES

REFERENCE NUMERALS IN DRAWINGS

| | | | |
|---|---|---|---|
| 14 | dispensing package | 16 | cup |
| 17 | opening | 18 | opening |
| 20 | back panel | 22 | opening |
| 24 | front panel | 26 | flange |
| 28 | flange | 30 | cavity wall |
| 32 | nesting wall | 34 | hinge |
| 36 | insert | 38 | collapsed tube |
| 40 | dispensing tube | 42 | closed end |
| 44 | opening | 46 | string of lights |
| 48 | cup | 50 | back panel |
| 52 | hole | 54 | flange |
| 56 | sticker | | |

Figure 1:
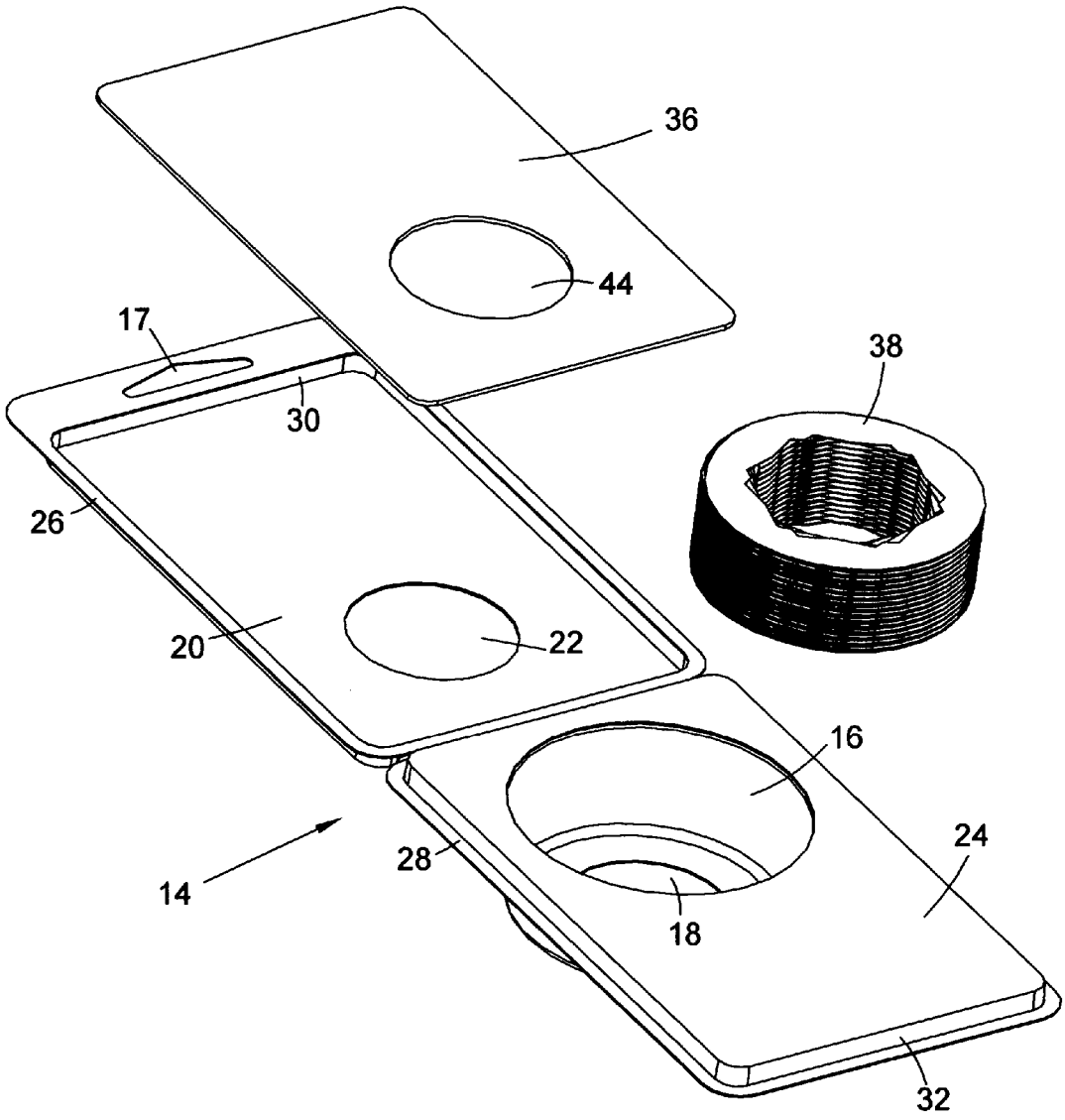
FIG. 1 is an oblique view of the components of a first and preferred embodiment of the present invention.
Figure 2:
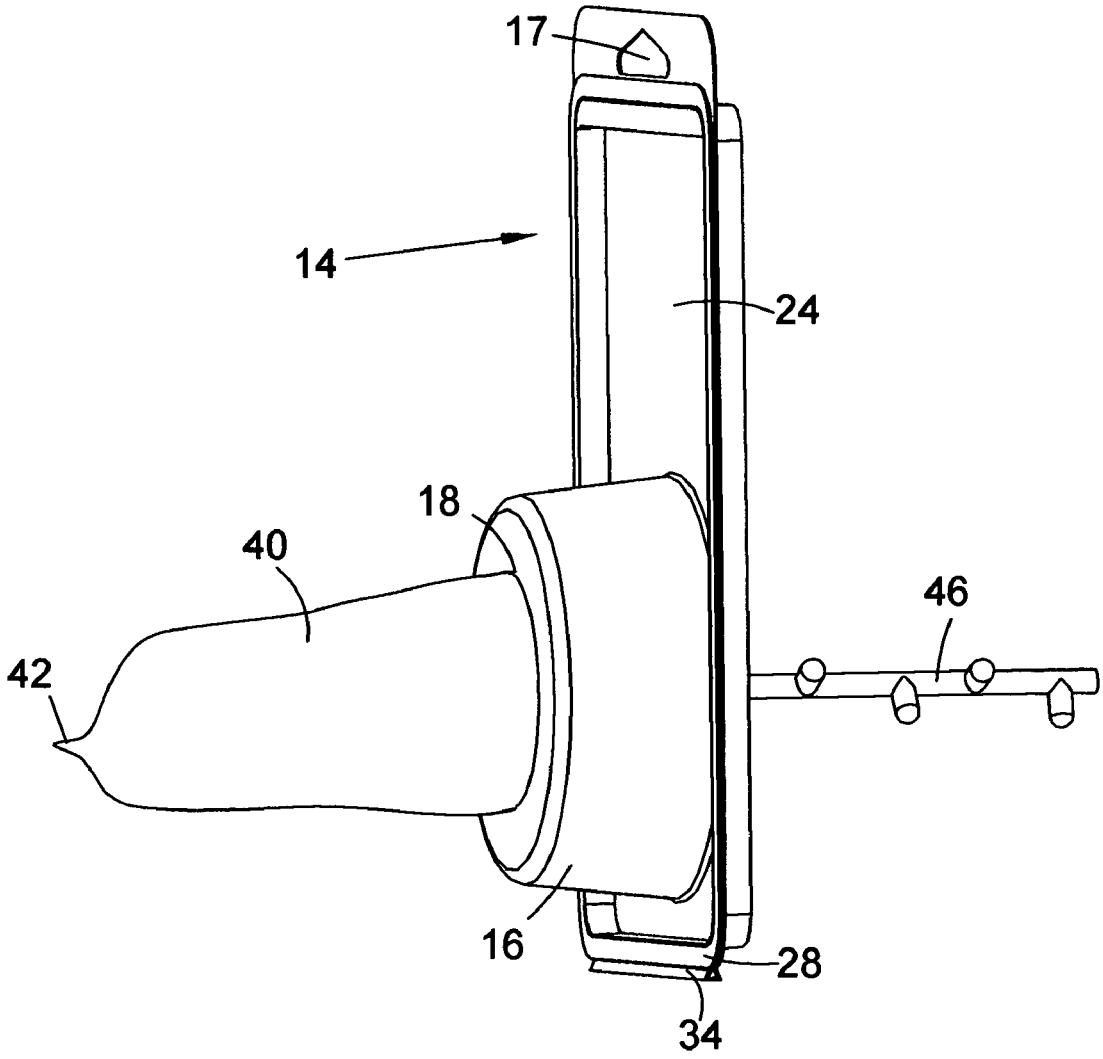
FIG. 2 shows a plastic tube being dispensed onto a string of lights.
Figure 3:
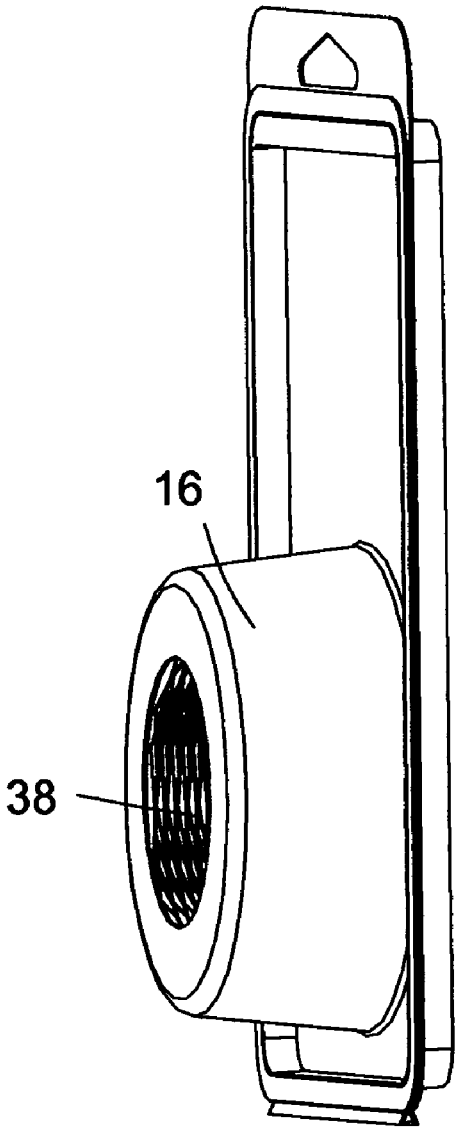
FIG. 3 shows the components of FIG. 1 assembled.

Description—FIGS. 1 through 3—Preferred Embodiment

A preferred embodiment of the present invention is illustrated in FIGS. 1, 2, and 3. In FIG. 1 a dispensing package 14 is shown in an unfolded form. It is of typical plastic "blister pack" construction as is commonly found at point-of-sale displays. Such construction is usually vacuum formed from thin and stiff plastic sheets. Dispensing package 14 might be formed from plastic material only 0.020 inch, for example. Such construction is relatively stiff, transparent, and economical to produce.

A front panel 24 has an integral cup 16 formed into it. Cup 16 has a wall that may be slightly tapered, but can be considered to have a nominal inner diameter. The wall of cup 16 might have an inner diameter of 3½ inches and a height of 1½ inches, for example. The bottom of cup 16 has a circular opening 18, which might be 2 inches in diameter, for example. The bottom of the cup has an inner and outer surface.

Front panel 24 is surrounded by a nesting wall 32 which causes the front panel to be raised above a surrounding flange 28. A back panel 20 is recessed below a flange 26 by means of a cavity wall 30. Back panel 20 has an inner and an outer surface. The dimensions of back panel 20, cavity wall 30, front panel 24, and nesting wall 32 are such that the front panel can nestingly fit into the cavity formed by cavity wall 30.

Flange 26 and flange 28 are joined by an integral hinge 34, as shown in FIG. 2. Hinge 34 is of the type commonly called a living hinge. That is, it has no moving parts; the hinge action is achieved by bending the plastic material. Bending dispensing package 14 at hinge 34 permits the two halves of the dispensing package to be nestingly fitted together. There are many configurations of living hinges commonly used that would be suitable.

There is an opening 22 in the surface of back panel 20. Opening 22 is so positioned that, when dispensing package 14 is closed about hinge 34, it is concentric with opening 18 in cup 16. Opening 22 is the same diameter as opening 18.

An opening 17 in flange 26 permits dispensing package 14 to be hung on a rod such as is commonly provided with point-of-sale displays. Opening 17 can be of any suitable shape and size.

An insert 36, preferably of paper or paperboard construction, has dimensions that allow it to nestingly fit within cavity wall 30 and against back panel 20. Insert 30 has an opening 44 that is concentric with opening 22 when the insert is positioned against back panel 20. Opening 44 is at least as large as opening 22. Insert 36 is printed with user instructions and with sales appeal text and artwork. It may be printed on one or both surfaces. With the insert encased within closed dispensing package 14, the printing is easily readable through the transparent plastic.

A collapsed tube 38 is made by longitudinally collapsing a long, thin-walled, plastic tube. The pre-collapsed tube might have a nominal diameter of 3 inches, and a length of 35 feet, for example. The tube material might be 0.0007-inch polyethylene, for example. With such dimensions, collapsed tube 38 can be made to fit within cup 16 when dispensing package 14 is closed. The collapsed tube has an inner passageway—as shown in FIG. 1—of approximately 2 inches diameter. Collapsed tube 38 is shown with open ends in FIG. 1, for clarity. In practice, one end of the tube should be closed, as shown by a closed end 42 in FIG. 2. The end may be heat sealed closed, or stapled, or knotted with a simple overhand knot, for examples. Although it is not essential that one end of the tube be closed, a closed end will make the device easier to use.

FIG. 3 shows the various components assembled, with the dispensing package closed. The dispensing package may be securely held closed by stapling flanges 26 and 28 together, or by heat-sealing them, or by the use of adhesives, for examples.

Figure 4:
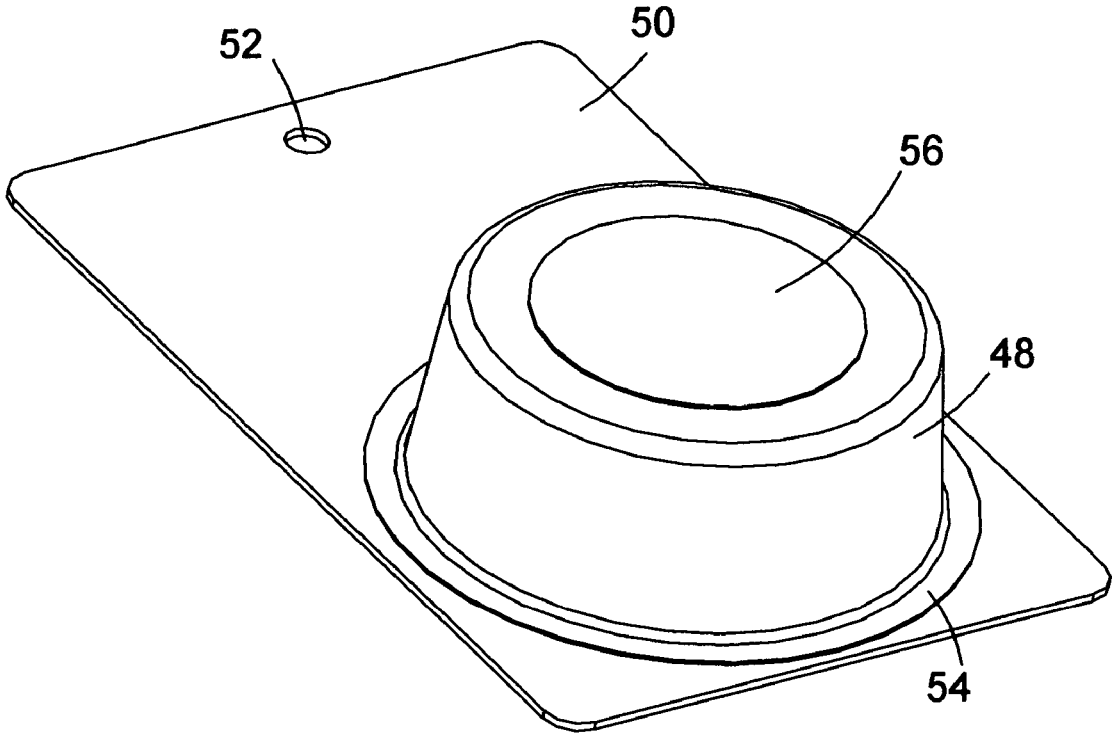
FIG. 4 is an oblique view of a second, and more economical, embodiment.

Not shown, in FIGS. 1 through 3, is a means of temporarily closing opening 18 and opening 22. The preferred means of temporarily closing each of these openings is with a removable sticker 56, which is shown in FIG. 4. Sticker 56 is a plastic or paper sticker with a peelable adhesive that permits the sticker to be removed at time of use. The sticker is slightly larger than the opening to be covered. It is printed to contribute to the package decoration. It may have instructions printed on it. As shown in FIG. 4, sticker 56 is applied to the outside of the assembled package.

FIG. 2 shows a portion of a dispensed tube 40 which encloses a hidden portion of a decorative light string 46. Dispensed tube 40 is created by expanding a portion of collapsed tube 38. Decorative light string 46 is shown in FIG. 2 as it passes through opening 22, which is not shown in FIG. 2.

Operation—FIGS. 1 through 3—Preferred Embodiment

Collapsed tube 38 is tightly collapsed by force. It has a tendency to expand, and would do so if not constrained. It is obvious that the inner wall of cup 16 keeps the collapsed tube, or any part of it, from moving perpendicular to its own axis, thus constraining it. The inner surface of the bottom of cup 16, that part surrounding opening 18, constrains one end of the collapsed tube. The other end of the collapsed tube is constrained by a portion of the inner surface of back panel 20. It is apparent that openings 18 and 22 are always maintained concentric to the collapsed tube by the geometry of dispensing package 14.

With collapsed tube 38 so constrained, it maintains its shape. Its interior passage way is maintained. Even though the collapsed tube is well protected by dispensing package 14, it takes very little force to pull out dispensed tube 40 during use.

At the time of use, stickers 56 are removed from openings 18 and 22. One end of light string 46 is sequentially through opening 22, through the center of collapsed tube 38, and out through opening 18, see FIG. 2. Because of closed end 42 of collapsed tube 38, string of lights 46 will pull dispensed tube 40 off of the collapsed tube as it passes through. The dispensed tube thereby encases the string of lights, providing the desired results. The action is much simpler than that required by prior art.

The described action can be accomplished by holding the device in one hand and one end of the string of lights in the other hand. When the end of the string has passed through the device, grasp the dispensed tube in one hand and the device in the other hand. By moving the hands apart, the light string is encased. Continue to regrip the dispensed tube, and pull more dispensed tube out until the entire string of lights has passed through the device. It takes only a few seconds. Either cut the tube, or pull it apart. It takes very little force to pull it apart. Tie the thus created open end with a simple overhand knot. The string of lights is ready for storage, and the device is ready to encase another string.

It will be appreciated that closed end 42 may be at either end of collapsed tube 38 by design. In one case, the dispensed tube will be dispensed from the end of the collapsed tube and immediately pass through opening 18. In the other case, the dispensed tube will be dispensed from the end of the collapsed tube and will pass through its own interior before passing through opening 18. Both methods are valid. It is also obvious that the direction of flow can be reversed without detriment. That is, string of lights 46 may be passed sequentially through opening 18, collapsed tube 38, and out through opening 22.

Description—FIG. 4—Second Embodiment

A second, and more economical, embodiment is shown in FIG. 4. A cup 48, similar in construction to cup 16 of FIG. 1, encloses collapsed tube 38, not shown, as in the first embodiment. Differing from the first embodiment, cup 48 has a flange 54. A back panel 50 replaces back panel 20 of the first embodiment. Back panel 50 is preferably paperboard, but may be plastic. Back panel 50 is printed similar to insert 36 of FIG. 1. Back panel 50 has an opening 52. Opening 52 is similar to opening 17 of FIG. 1, and serves the same function.

Cup 48 and back panel 50 each have a circular opening that corresponds to openings 18 and 22 of FIG. 1, respectively.

With the components assembled, flange 54 is fastened to back panel 50 with staples, or with heat sealing, or with adhesive, for examples.

Removable stickers 56 cover the holes in cup 48 and back panel 50, as described in the first embodiment.

Operation—FIG. 4—Second Embodiment

The operation of the second embodiment is the same as that of the first embodiment.

Conclusion, Ramifications, and Scope

Accordingly, the reader will see that the present invention, as defined by the embodiments described, herein, can be used to prepare decorative light strings for storage, with an economy, ease and convenience not obtainable with prior art. Specifically:

- it provides a light string storage device that does not increase the storage space or the stored mass significantly.
- it provides a light string storage device that easy to use and that is quickly applied.
- it provides a disposable light string storage device.
- it provides a light string storage device made from a very small amount of materials, that are also recyclable.
- it provides a light string storage device that is not location limited.
- it provides a light string storage device that is very economical to produce.
- it provides a light string storage device that is very robust, and suited to the retail and home environment.
- it provides a light string storage device with a very small point of sale package.
- it provides a light string storage device that protects against dust and damage.
- it provides a light string storage device that prevents tangling of single or multiple strings.
- it provides a light string storage device that allows the strings to be quickly and easily reused.
- it provides a light string storage device that allows the strings to be stored in boxes or to be coiled and stored on pegs.

Although the above descriptions contain many specificities, these should not be construed as limiting the scope of the invention but as merely providing illustration of some of the presently preferred embodiments of this invention. Many other variations are possible. For examples:

(1) hinge 34 described in the preferred embodiment may be omitted; dispensing package 14 may be made up of two components.

(2) instead of covering openings 18 and 22 with stickers 56, openings 18 and 22 may be replaced with scored or perforated circles, thus allowing the circles to be punched out at the time of use.

(3) the material of collapsed tube 38 may be of any suitable material and thickness.

(4) the dimensions given as examples are suitable for many decorative light strings. However, the dimensions can be increased or decreased as is appropriate to customize the invention to special cases.

(5) cup 16 and cup 48 are not limited to circular cross-section. They may have decorative shapes: star shaped, wreath shaped, or polygonal shaped, for examples.

(6) cup 16 and cup 48 are shown one to a package; back panel 20 and back panel 50 could have similar cups that are concentric with the cups shown. The effect would be to increase the amount of tubing that can be stored.

(7) more than one cup 16 or cup 48 could be placed on one dispensing package. By placing cups side by side, more tubing can be provided without increasing the depth of the package.

(8) the portions of the dispensing package, that do not constrain collapsed tube 38, are not essential to the dispensing operation. A basic device can be made having only collapsed tube 38, and a constraining cylinder with a top and a bottom surface, each having a hole corresponding to openings 18 and 22 respectively.

The scope of usage extends beyond decorative light strings, and includes, but is not limited to:

protecting electrical cable assemblies during storage or shipment.

protecting fishing, wire-or-cable assemblies during storage or shipment.

protecting model rocket or airplane parachutes during storage.

Accordingly, the scope of the invention should be determined not by the embodiments illustrated, but by the appended claims and their legal equivalents.

We claim:

1. A method for protecting a decorative-light string, or strings, comprising the steps of:

a. providing a longitudinally compressed long, thin-walled plastic tube, that forms a short collapsed tube having an inner passageway, and b. providing a constraining wall with a height roughly equal to that of said collapsed tube and with an effective inner diameter roughly equal to an outer diameter of said collapsed tube, and c. providing a first constraining surface having a first opening with a diameter roughly equal to that of said inner passageway, and d. providing a second constraining surface having a second opening with a diameter roughly equal to that of said inner passageway, wherein said constraining wall and said first constraining surface and said second constraining surface together effectively constrain said collapsed tube, and wherein said first opening and said second opening are concentric with said inner passageway, and e. passing said decorative-light string sequentially through said first opening, said inner passageway, and said second opening, whereby said decorative-light string is encased within said thin-walled plastic tube as it passes through said inner passageway.

2. The method of claim 1, wherein said thin-walled plastic tube in said collapsed tube has one closed end, whereby initial dispensing is facilitated.

3. The method of claim 1, wherein said said constraining wall comprises a plurality of walls to achieve said height, whereby increased tube capacity is achieved.

4. A device for protecting a decorative-light string, or strings, comprising:

a. a longitudinally compressed long, thin-walled plastic tube, that forms a short collapsed tube having an inner passageway, and b. a constraining wall with a height roughly equal to that of said collapsed tube and with an effective inner diameter roughly equal to an outer diameter of said collapsed tube, and c. a first constraining surface having a first opening with a diameter approximately equal to that of said inner passageway, and d. a second constraining surface having a second opening with a diameter approximately equal to that of said inner passageway, wherein said constraining wall and said first constraining surface and said second constraining surface together effectively constrain said collapsed tube, and wherein said first opening and said second opening are concentric with said inner passageway, whereby said decorative-light string is encased within said thin-walled plastic tube as it is passed through said inner passageway.

5. The device of claim 4, wherein said thin-walled plastic tube in said collapsed tube has one closed end, whereby initial dispensing is facilitated.

6. The device of claim 4, wherein said constraining wall comprises a plurality of walls to achieve said height, whereby increased tube capacity is achieved.

7. The device of claim 4, further including a plurality of said collapsed tubes, said constraining walls, and said constraining surfaces, whereby increased tube capacity is achieved.

8. The device of claim 4, wherein said first and second openings are replaced with scored or perforated circles, whereby the openings can be created at the time of use.

9. The device of claim 4, wherein said constraining wall, said first surface, and said second surface are integral parts of a sales package, whereby production costs are lowered.

* * * * *